United States Patent [19]

Anikanov et al.

[11] 4,015,404

[45] Apr. 5, 1977

[54] APPARATUS FOR BUNDLING STACKS OF NEWSPAPERS

[76] Inventors: Nikolai Ivanovich Anikanov, Bolshaya Bronnaya ulitsa, 2/6, kv. 6, Moscow; Evgeny Arkadievich Baburin, Prospekt Romena Rollana, 25, kv. 264, Kiev; Leonid Pavlovich Grachev, Serafimovicha ulitsa, 2, kv. 181, Moscow; Grigory Iosifovich Zax, Mechnikova ulitsa, 14a, kv. 24, Kiev; Grigory Avramovich Radutsky, 16 Parkovaya ulitsa, 49, korpus 2, kv. 68; Mikhail Evseevich Frumkin, Naberezhnaya-Novikova-Proboya, 9, kv. 34, both of Moscow; Rafail Efimovich Kheifets, Brest-Litovsky prospekt, 162, kv. 30, Kiev, all of U.S.S.R.

[22] Filed: Feb. 19, 1976

[21] Appl. No.: 659,519

Related U.S. Application Data

[63] Continuation-in-part of Ser. No. 624,560, is a continuation of Ser. No. 459,346, April 9, 1974, abandoned.

[30] Foreign Application Priority Data

Apr. 13, 1973 U.S.S.R. ..... 899752

[52] U.S. Cl. ..... 53/218

[51] Int. Cl.[2] ..... B65B 11/02

[58] Field of Search ..... 53/218, 124 C

[56] References Cited

UNITED STATES PATENTS

| | | | |
|---|---|---|---|
| 2,027,010 | 1/1936 | Zeigler | 53/218 |
| 3,604,182 | 9/1971 | Jepsen | 53/124 C |

*Primary Examiner*—Travis S. McGehee
*Attorney, Agent, or Firm*—Holman & Stern

[57] ABSTRACT

The invention relates to apparatus for bundling stacks of newspapers. The apparatus includes a rollerway for conveying a stack into the wrapping-up zone defined by an endless roller conveyor and a frame, a device being mounted to each side of the rollerway for protecting the newspapers in a stack from crumpling, including a pivotable bell crank rotatable into two alternative positions in one of which the free arm of the bell crank is introduced into the area to be occupied by the end faces of the bundle-to-be and is aligned with the bottom edge of the stack. In the other position the arm is retracted from under the wrapping paper, to enable the stack to leave the roller conveyor unobstructedly.

2 Claims, 2 Drawing Figures

APPARATUS FOR BUNDLING STACKS OF NEWSPAPERS

Figure 1:
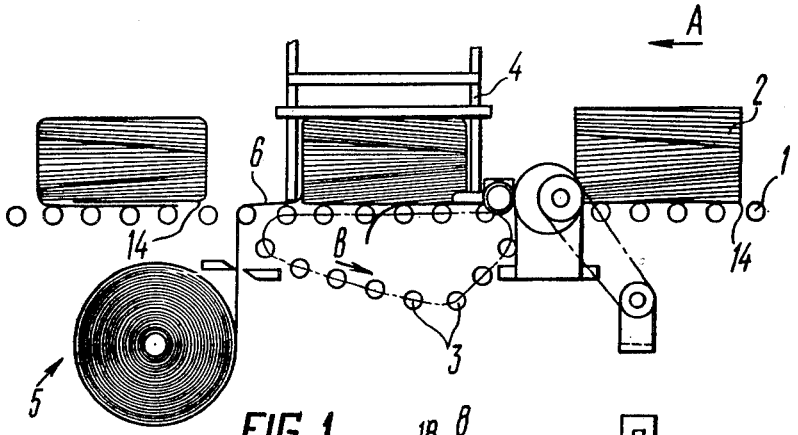

The present Application is a continuation-in-part of the previous application Ser. No. 624,560 filed Oct. 21, 1975 which in turn is a continuation of application Ser. No. 459,346 filed on Apr. 9, 1974, both now abandoned, and presents an improvement of the apparatus claimed therein.

In the abovementioned previous Application there was disclosed an apparatus for bundling stacks of newspapers, comprising a rollerway for feeding stacks of newspapers, an endless driven roller conveyor for accepting stacks fed by the rollerway, arranged downstream or behind of the rollerway in the stack feeding direction and being adapted to be intermittently driven by an associated drive means, a detachable frame arranged above the said roller conveyor, means for feeding wrapping paper intermediate the frame and a stack, the width of the wrapping paper web being somewhat greater than the width of the stack, for margins of this wrapping paper web to protrude in the areas of the end faces of the bundle-to-be. The said frame is reciprocable in a vertical plane, to be put over the wrapping paper onto the stack, whereby the stack becomes wrapped up at its top plane and two side ones, in which way a bundle with open end faces is formed. One of the ends of the wrapping paper is introduced to underlie the bottom side of the stack by the motion of the roller conveyor, whereas the other end of the wrapping paper is introduced under the stack, as the frame is forwarded jointly with the stack onto the delivery rollerway.

Although the disclosed apparatus provides for obtaining bundles of adequate quality, it is, however, practically incapable of bundling stacks containing a small number of newspapers, e.g. one or two. This is explained by the fact that as the ends of the wrapping paper are being introduced in the disclosed apparatus under the bottom side of such a stack, the bottommost newspaper is liable to get crumpled and rolled about together with the wrapping paper, on account of the small weight of the stack, i.e. of the inadequate effort urging the stack against the roller conveyor.

It is an object of the present invention to eliminate the abovespecified disadvantage of the disclosed apparatus.

It is an important object of the present invention to create and apparatus for bundling stacks of newspapers, which should be capable of bundling a stack with a small number of newspapers therein, e.g. a stack including a single newspaper.

These and other objects are attained in an apparatus for bundling stacks of newspapers, wherein, in accordance with the invention, a device for retaining newspapers in a stack from being crumpled is mounted to each side of the feed-in rollerway in the stack wrapping-up zone defined by the frame and the roller conveyor, each said device including a bell crank pivotable about a pivot axis in the plane parallel with the motion of the feed-in rollerway, one arm of the said bell crank being operatively connected with the drive of the said roller conveyor, for pivoting said bell crank into two alternative positions, in one of which the other, free arm of said bell crank is introduced into the area of the protruding margins of the wrapping paper and is aligned with the lower edge of the stack, foremost in the direction of the latter's advance, for the said margins of the wrapping paper to be guided about the said free arms, as the wrapping paper is being introduced under the bottom side of the stack; in the other of said alternative positions, at the moment when the operation of introducing the wrapping paper under the bottom side of the stack is being completed, said free arm is retracted from under the wrapping paper, to enable the stack to leave the roller conveyor unobstructedly, the operative connection between the first arm of the bell crank with the drive of the roller conveyor being such that the bell crank is driven from said second position into said first position thereof before the motion of the roller conveyor is arrested.

With the apparatus having the herein disclosed structure, it is capable of wrapping up stacks with a small number of newspapers therein, as small as one, since the margin of the wrapping paper is rolled under the bottom side of the stack, while being guided about the respective arms of the bell cranks, which are aligned with the leading lower edge of the stack and present a kind of a "reinforcing rib" of the stack, taking upon themselves the entire load of the moving wrapping paper.

To simplify the structure of the herein disclosed apparatus, it is expedient that the operative connection of the bell crank with the drive of the roller conveyor should include a follower mounted on said bell crank and a cam secured on a shaft driven by said drive, the cam being engaged by the follower which is permanently urged into engagement with the cam by an effort of a spring means.

Figure 2:
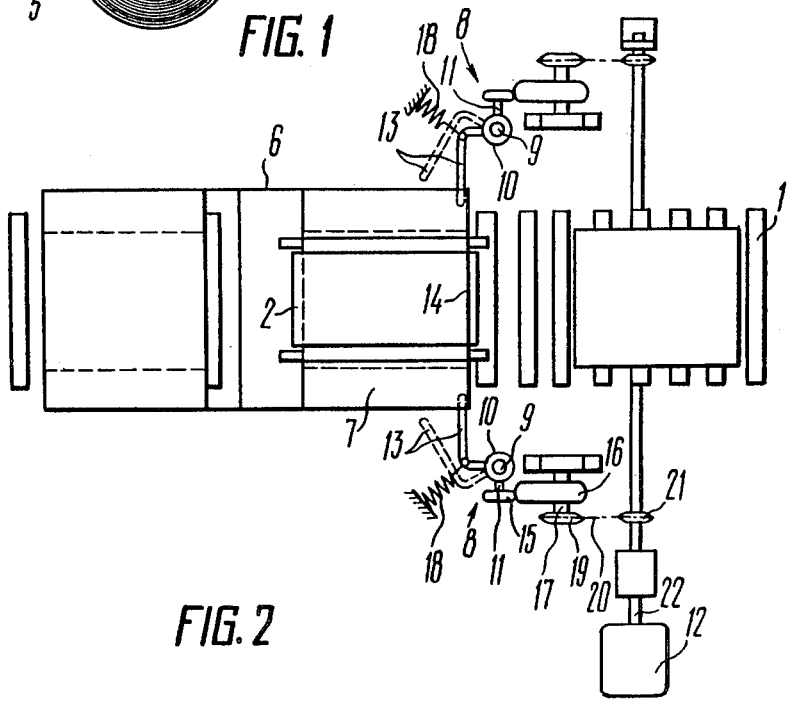

The present invention will be better understood from the following description of an embodiment thereof, with reference being had to the appended drawings, wherein:

FIG. 1 is the general schematic side view of an apparatus for bundling stacks of newspapers, FIG. 2 is a plan view of the same apparatus, with the arms of the bell cranks shown in two positions.

The herein disclosed apparatus comprises a rollerway 1 (FIG. 1) for feeding stacks 2 of newspapers in succession to the wrapping-up zone defined by an endless roller conveyor 3 and a frame 4.

The frame is arranged above the roller conveyor 3 and is vertically reciprocable, so that it can be put about a stack 2. The frame can be reciprocated by any suitable known per se drive means, which forms no part of the present invention and is not described here.

The apparatus includes means 5 for feeding a web of wrapping paper 6 intermediate the frame 4 and a stack 2, the width of this paper web being somewhat greater than that of the stack 2, so that margins 7 of the wrapping paper 6 are protruding in the areas of the end faces of the bundle-to-be, as it can be seen in FIG. 2.

The endless roller conveyor 3 is adapted to be intermittently driven by any suitable drive means (12, to be described hereinbelow). The rollerway feeds in successive stacks in general direction indicated in the drawing with arrow line A, while the direction of the motion of the conveyor 3 is illustrated with arrow line B.

In the wrapping-up zone there is mounted at each side of the rollerway 1 a device 8 for retaining newspapers in a stack against crumpling. Each device 8 includes a pivot axis 9 on which there is pivotably mounted a bell crank 10 which is pivotable in the plane of the feeding motion of the rollerway 1, i.e. in the top plane of the rollerway 1. The pivoting of the bell crank 10 is effected by an operative connection of the first arm 11 of the bell crank 10 with the drive 12 of the roller conveyor 3. The bell crank 10 is pivotable between two alternative positions in the first of which the other free end 13 of the bell crank 10 is projected into the area of the margins 7 of the wrapping paper web 6 and is aligned with the leading lower edge 14 of the stack 2, whereby the margins 7 are guided about these arms 13 as the wrapping paper 6 is being introduced to under lie the stack. Owing to this position of the arms 13, the latter present a kind of a reinforcing rib for the stack and thus prevent its being crumpled. In the other position of the bell crank, at the moment of completion of the operation of introducing the wrapping paper to underlie the bottom side of the stack, the arm 13 of the bell crank 10 is retracted from under the wrapping paper 6, i.e. the bell cranks 10 acquire a position shown in dash lines in FIG. 2, whereby the stack 2 can leave the roller conveyor 3 unobstructedly.

The operating connection of the arm 11 of the bell crank 10 with the drive 12 is such that the bell crank is pivoted from the second, retracted position into the first, projecting one before the roller conveyor 3 completes the cycle of its intermittent motion. The operative connection in the presently described embodiment includes a follower 15 mounted on the first arm 11 of the bell crank 10 and a cam 16 of a corresponding shape, secured on a shaft 17 driven from the drive 12, the cam 16 being engaged by the follower 15. The permanent engagement of the follower 15 with the cam 16 is effected by an extension spring 18 having one its end secured to the framework of the apparatus and its other end attached to the arm 13 of the bell crank 10. The shaft 17 is driven by having a sprocket wheel 19 mounted thereon and connected by an endless chain 20 with another sprocket wheel 21 mounted on the shaft 22 of the drive 12.

The herein disclosed apparatus operates, as follows.

With the rollerway 1 and the roller conveyor 3 being simultaneously driven, the stack 2 is fed in the direction indicated with the arrow line A into the wrapping-up zone. When the stack 2 is completely supported by the roller conveyor 3, the drive of the latter is deenergized, whereby the stack 2 stands still. Now the means 5 for feeding the web of the wrapping paper 6 unwound from a supply roll is energized to guide the paper 6 above the stack 2, so that the leading end of the web 6 shall be introduced into the gap between a pair of successive rollers of the conveyor 3. Then the frame 4 is lowered from above onto the stack, the frame being put over the wrapping paper 6, and the drive 12 of the roller conveyor 3 is energized. As it has been explained hereinabove, before the drive 12 is energized, the bell cranks 10 occupy a position whereat their arms 13 are projected into the area of the margins 7 of the web of the wrapping paper 6, so that the leading end of the web of the wrapping paper 6 shall be guided about these arms 13, as it is being introduced under the stack 2.

With the drive 12 of the roller conveyor 3 energized, the rollers of the latter draw the leading end of the web to underlie the bottom side of the stack, while the free arms 13 of the bell crank 10 are driven, on account of the follower 15 rolling onto a smaller radius of the cam 16, from under the paper 6 and finally acquire the idling position shown in dash lines in the drawing, thus enabling the stack 2 jointly with the frame 4 to leave unobstructedly the roller conveyor 3. Simultaneously, the appropriate length of the web of the wrapping paper 6 is severed from the supply roll and, as the stack 2 is leaving the roller conveyor 3, this other end of the paper 6 is guided under the bottom side of the stack 2, over the formerly leading end of the paper 6, which has already been wrapped about this bottom side on the stack. The moment the stack 2 leaves completely the roller conveyor 3, the drive 12 of the latter is deenergized, while the arms 13 of the bell cranks 10 once again occupy their working position, owing to the follower 15 having rolled onto the greater radius of the cam 16. Then the abovedescribed cycle repeats itself.

What we claim is:

1. In an apparatus for bundling stacks of newspapers, comprising a feed-in rollerway for feeding stacks of newspapers, an endless driven roller conveyor for accepting stacks fed in by said rollerway, arranged downstream of the rollerway in the stack feeding direction and being adapted to be intermittently driven by an associated drive means, a detachable frame arranged above said roller conveyor, means for feeding a web of wrapping paper intermediate said frame and a stack, the width of the web of wrapping paper being somewhat greater that the width of the stack, for margins of this wrapping paper web to protrude in the areas of the end faces of the bundle-to-be, said frame being reciprocable in a vertical plane to be put over the wrapping paper onto the stack, whereby the stack becomes wrapped up at its top plane and two sides, in which way a bundle with open end faces is formed, an improvement residing in that in the stack wrapping-up zone defined by the frame and said roller conveyor there is mounted to each side of said feed-in rollerway a device for retaining newspapers in the stack from being crumpled, each said device including a bell crank pivotable about a pivot axis in a plane parallel with the feeding direction of said feed-in rollerway, one arm of said bell crank being operatively connected with the drive means of said roller conveyor, for pivoting said bell crank into two alternative positions in one of which the other, free arm of said bell crank is introduced into the area of the protruding margins of the wrapping paper web and is aligned with the lower edge of the stack, foremost in the direction of the latter's advance, for the said margins of the wrapping paper web to be guided about the said free arm as the wrapping paper web is being introduced to underlie the bottom side of the stack; in the other of said alternative positions, at the moment when the operation of introducing the wrapping paper to underlie the bottom side of the stack is nearing its completion, said free arm is retracted from under the wrapping paper web, to enable the stack to leave the roller conveyor unobstructedly, the operative connection between the first-mentioned arm of said bell crank an the drive means of said roller conveyor being such that the bell crank is driven from said second position into said first position thereof before the motion of the roller conveyor is arrested.

2. An apparatus by claim 1, wherein the operative connection of the bell crank with the drive means of the roller conveyor includes a follower supported by said bell crank and a cam secured on a shaft driven by said drive means, this cam being engaged by the follower which is permanently urged into engagement with the cam by an effort of a spring means.

* * * * *